US006929708B1

(12) United States Patent
Wyman et al.

(10) Patent No.: US 6,929,708 B1
(45) Date of Patent: Aug. 16, 2005

(54) FILM SPLICING AND CUTTING MECHANISM

(75) Inventors: Eric Wyman, Austin, TX (US); Thomas Pearce, Ruther Glen, VA (US); Mark Manzi, Chesterfield, VA (US); Roland Lomerson, Jr., Bradenton, FL (US)

(73) Assignee: Bakery Holdings LLC, Richmond, VA (US)

( * ) Notice: Subject to any disclaimer, the term of this patent is extended or adjusted under 35 U.S.C. 154(b) by 0 days.

(21) Appl. No.: 10/997,296

(22) Filed: Nov. 24, 2004

(51) Int. Cl.[7] ..... B65H 21/00

(52) U.S. Cl. ..... 156/159; 156/251; 156/502; 156/515; 156/530; 242/553; 242/555.5; 242/555.6

(58) Field of Search ..... 156/157, 159, 156/251, 502, 504, 515, 530; 242/551, 552, 242/553, 556, 555.5, 555.6

(56) References Cited

U.S. PATENT DOCUMENTS 3,610,547 A * 10/1971 Anderson ..... 242/552
4,815,405 A * 3/1989 Young, Jr. ..... 112/470.12
5,273,228 A * 12/1993 Yoshida et al. ..... 242/552
5,358,592 A * 10/1994 Fukuyama ..... 156/361
5,439,550 A * 8/1995 Ballestrazzi et al. ..... 156/515
5,653,848 A * 8/1997 Yamamoto et al. ..... 156/504
5,863,381 A * 1/1999 Magota et al. ..... 156/507
6,254,707 B1 * 7/2001 Sfikas et al. ..... 156/73.3
6,328,088 B1 * 12/2001 Draghetti ..... 156/504
6,799,622 B2 * 10/2004 Recchia, Jr. ..... 156/515

* cited by examiner

*Primary Examiner*—Mark A. Osele

(57) ABSTRACT

A splicing device comprising: an elongated anvil having an elongated slot therein; an elongated splicing head having a pair of spaced apart tips extending therefrom and having a longitudinal aperture therein; a heating element in the longitudinal aperture; and an actuator mechanism for driving one of the tips toward and into the elongated slot to weld two overlying polymer films together and the other of the tips into cutting contact with a polymeric film from a spent roll of film. According to various preferred embodiments, the splicing device further includes a pair of retaining members on either side of the anvil that serve to retain films to be spliced in taut contact with the anvil during splicing, and a turret section for rotating full and spent rolls of polymeric film into position for continued operation and reloading.

9 Claims, 7 Drawing Sheets

FILM SPLICING AND CUTTING MECHANISM

FIELD OF THE INVENTION

The present invention relates to devices for cutting and splicing polymeric films and the like, and more particularly to such a device that accomplished both of these operations in a single stroke.

BACKGROUND OF THE INVENTION

In many industries long, continuous and multi-roll volumes of polymeric films are handled, treated or processed for a wide variety of purposes including coating, use in packaging equipment as interleaving etc. In all of these applications of polymer films the handling of the polymer films requires that to maintain continuity of operation, rolls of polymeric film be spliced "on the fly" as one supply roll is consumed and another is brought on line without slowing the particular production operation in which they are involved.

While a wide variety of methods, systems and devices have been developed for splicing such materials in such applications such as transverse roll traversing apparatus, laser welding etc. all such prior art systems tend to be relatively slow, often involving accumulators or the like, or if high speed relatively expensive due to the technology that is required to implement them.

Thus, there remains a need for a relatively simple yet high speed system or device for splicing polymeric film materials.

OBJECT OF THE INVENTION

It is therefore an object of the present invention to provide a splicing device that is mechanically based, simple to operate and maintain yet sufficiently high speed to meet the requirements of most polymer film handling systems.

SUMMARY OF THE INVENTION

According to the present invention, there is provided a splicing device comprising: an elongated anvil having an elongated slot therein; an elongated splicing head having a pair of spaced apart tips extending therefrom and having a longitudinal aperture therein; a heating element in the longitudinal aperture; and an actuator mechanism for driving one of the tips toward and into the elongated slot and the other of the tips into cutting contact with a polymeric film from a spent roll of film. According to various preferred embodiments, the splicing device further includes a pair of retaining members on either side of the anvil that serve to retain films to be spliced in taut contact with the anvil during splicing, and a turret portion for rotating full and spent rolls of polymeric film into position for continued operation and reloading.

DETAILED DESCRIPTION

Figure 1:
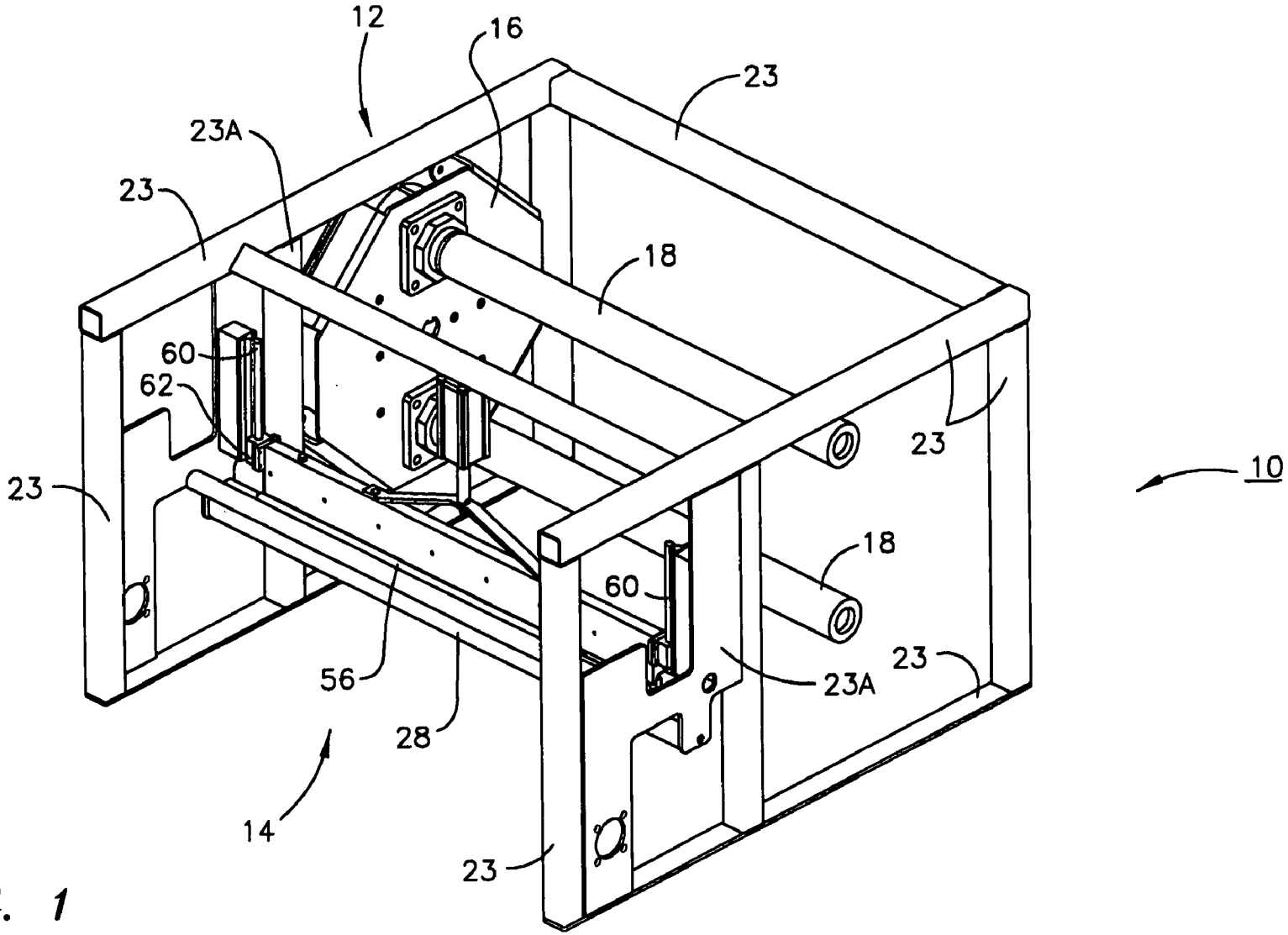
FIG. 1 is a perspective view of the splicing device of the present invention.
Figure 2:
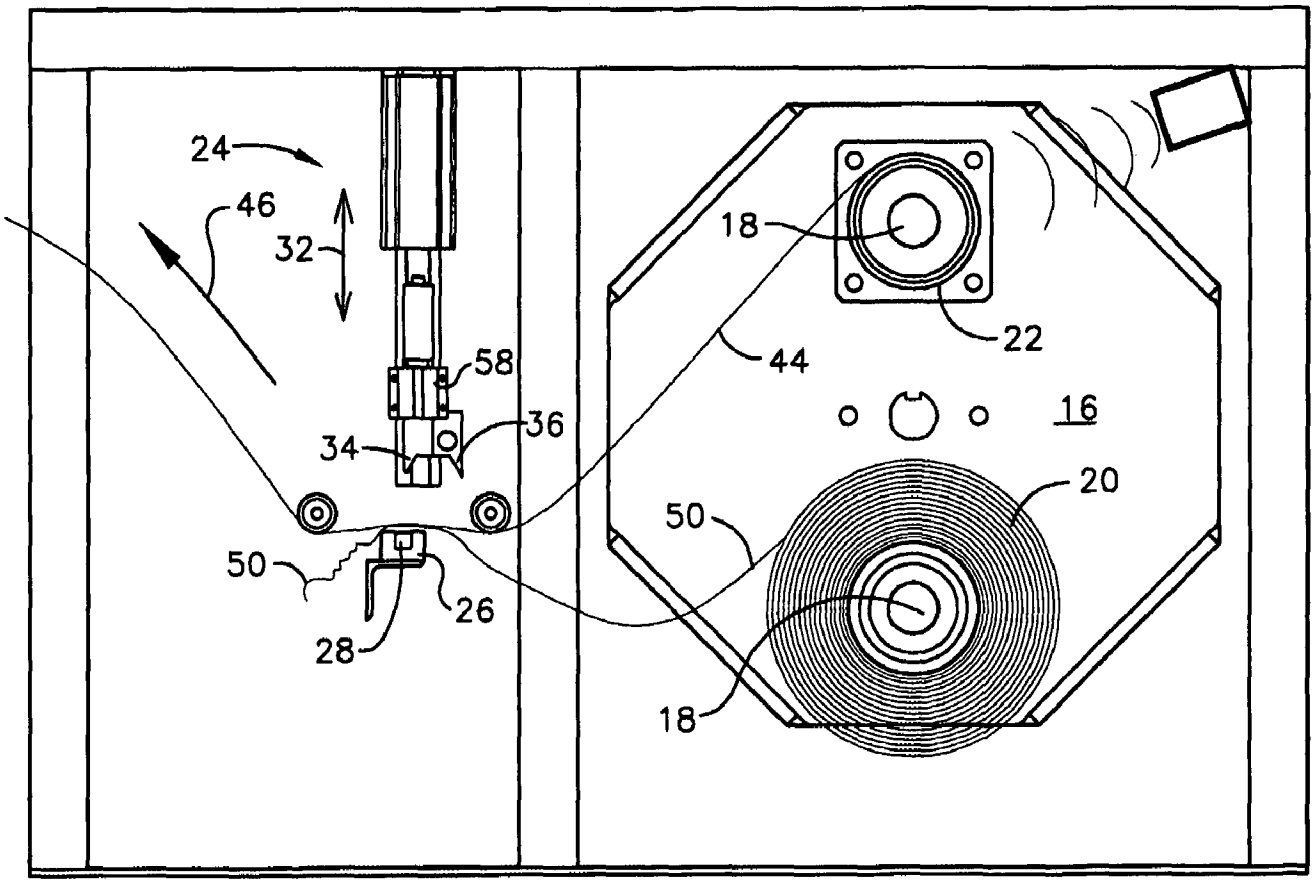
FIG. 2 is a partially cut-away side view of the splicing device of the present invention in the pre-splice position.

Referring now to FIG. 1, the splicing device 10 of the present invention comprises: 1) a turret section 12; and a splicing section 14. Both turret section 12 and splicing section 14 are mounted in a frame 23 that serves to hold the entire apparatus together. As best seen in FIGS. 2–7, turret section 12 is of a conventional design sell known in the polymer film handling arts comprising a rotating plate 16 having at least two shafts 18 for receipt of the cores of polymer film rolls or coils 20 and 22. As depicted in FIG. 2, roll 20 comprises a full roll which will serve to feed splicing section 14 and downstream equipment (not shown) and roll 22 comprises an almost spent or expiring roll of film that is about to run out and be replaced as a source of supply by roll 20. The operation of this turret mechanism, although well known in the art is depicted in the Figures that follow and described below.

Figure 4:
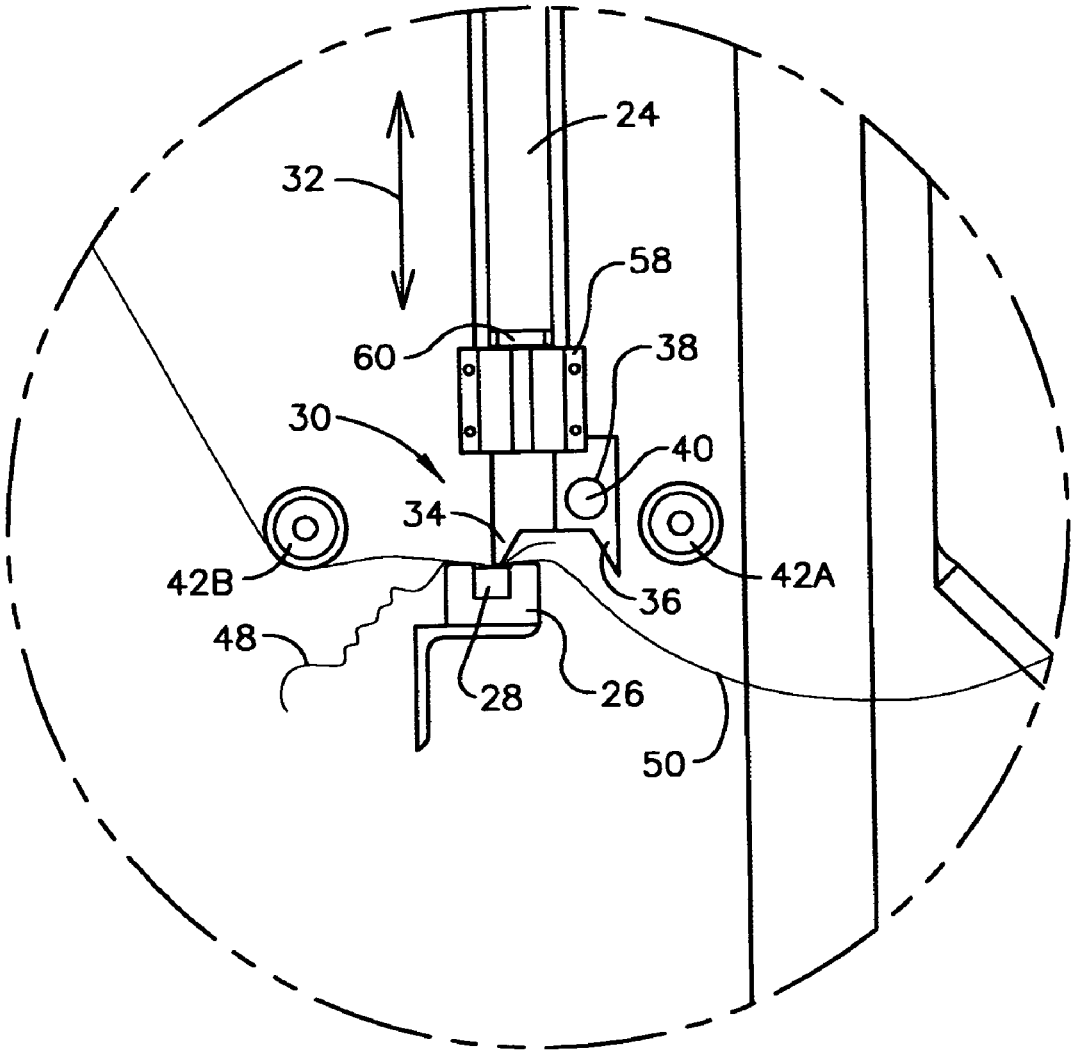
FIG. 4 is a close-up view of the blade portion of the splicing device of the present invention in the splicing position.

The novel portion of the splicing device of the present invention, depicted most clearly in FIG. 4, but also depicted in the other Figures comprises; an anvil 26 having a longitudinal slot 28 running the length thereof; an elongated splicing device head 30; and an actuator mechanism 24 that serves to drive splicing device head 30 in reciprocating motion in the directions as shown by double headed arrow 32. While in the accompanying drawings slot 28 is shown as being rectangular in shape it could, of course, be of any suitable shape that does not affect the operation of device 10 as described below.

Splicing device head 32 comprises an elongated aperture 38 running the length thereof that contains a heating element 40 similarly running the length of aperture 38 and a pair of spaced apart tips 34 and 36. Heating element 40 serves to heat both tips 34 and 36 to a temperature appropriate for splicing and cutting polymer film fed from rolls 20 and 22 as described below. Heating element 40 that may be of any suitable material and configuration well known in the art including various resistance type heaters etc. provides the heat necessary to accomplish cutting and splicing of polymeric films, as described below. As depicted in the various Figures, aperture 38 and contained heating element 40 are located in tip 36 that is remote from anvil 26 and slot 28 in the welding/cutting operation, since, as described below, tip 36 is that which will provide the cutting of polymer film 44 from spent roll 22 during the splicing operation and hence desirably is perhaps at a slightly elevated temperature from the temperature of tip 34. However, with the proper fabrication of splicing device head 30 and more specifically tips 34 and 36 from an appropriate high heat conductivity material such as aluminum or copper and alloys thereof, both tips 34 and 36 will be at relatively the same temperature, thus, aperture 38 could also be located in tip 34 or both tips 34 and 36 could contain apertures 38 and heating elements 40. Also depicted in FIGS. 2–7 are guide rollers 42A and 42B that serve to assure that polymer film drawn from rolls 20 and 22, i.e. films 44 and 50, are maintained in a taut and flat condition as they extend over anvil 26 and especially slot 28 during the splicing operation as described in greater detail below.

Referring now more specifically to FIGS. 2–7 that depict the various steps on the operation of device 10 of the present invention, as shown in FIG. 2 in the pre-splice condition polymer film 44 from spent roll 22 that is/has been moving in the direction indicated by arrow 46 is passing around roller 42A, passing over slot 28 in anvil 26 and thence around roller 42B. The end 48 of polymer film 50 from full/replacement roll 20 is fed under polymer film 44 over slot 28 and anvil 26 as shown in FIG. 2.

Figure 3:
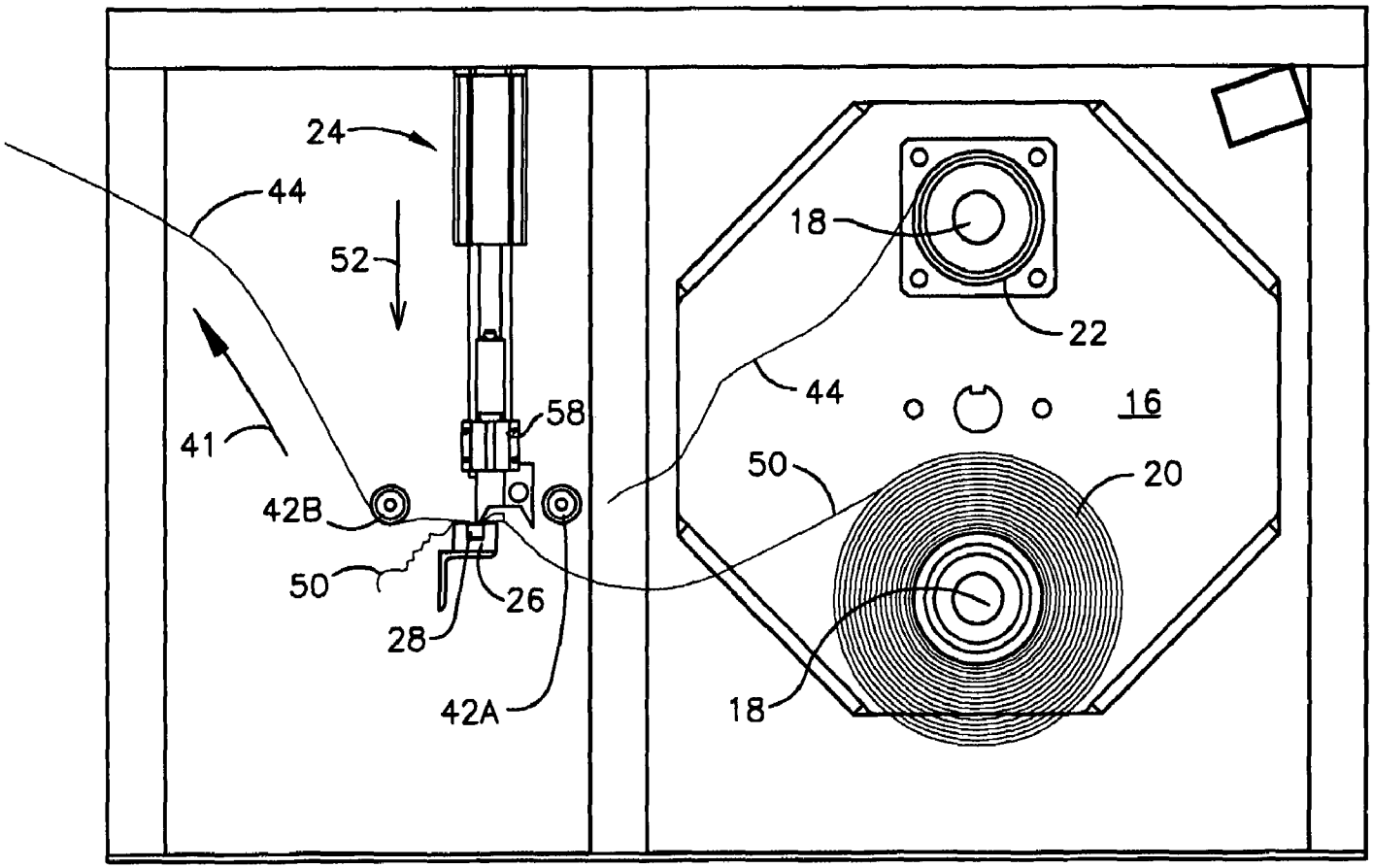
FIG. 3 is a partially cut-away view of the splicing device of the present invention in the splicing position.

As shown in FIGS. 3 and 4 that depict the actual splicing operation, actuator 24 drives splicing device head 30 downward in the direction indicated by arrow 52 causing tip 34 to come into intimate and heating contact with both polymer films 44 and 50 as tip 34 is driven by actuator 24 slightly into slot 28. Heat from tip 34 causes fusing or welding of polymer films 44 and 50 thereby connecting newly supplied polymer film 50 to expiring film 44. Simultaneously with this fusing or welding operation, heated tip 36 engages expiring polymer film 44 causing cutting thereof, as best seen in FIG. 3. Thus, in a single stroke, films 44 and 50 are fused or welded together so that supply of polymer film can now be drawn from roll 20 while expiring film 44 from roll 22 is removed from the operation by cutting with tip 36. Again, rollers 42A and 42B maintain polymer film 44 taut during the welding/cutting making cutting thereof by tip 36 easier. The pressure applied by tip 34 combined with the heat supplied by heating element 40 must, of course be adequate to fuse films 44 and 50 together, but so great as to cause parting or cutting of films 44 and 50 at the splicing location. The conditions for achieving such a state are readily determinable by the skilled artisan given the structure described herein. As will be observed from a viewing of the various Figures that depict splicing head 30, tip 34 is slightly more rounded, not as sharp or greater radius of curvature than cutting tip 36 to provide for easier control of this operation.

Figure 5:
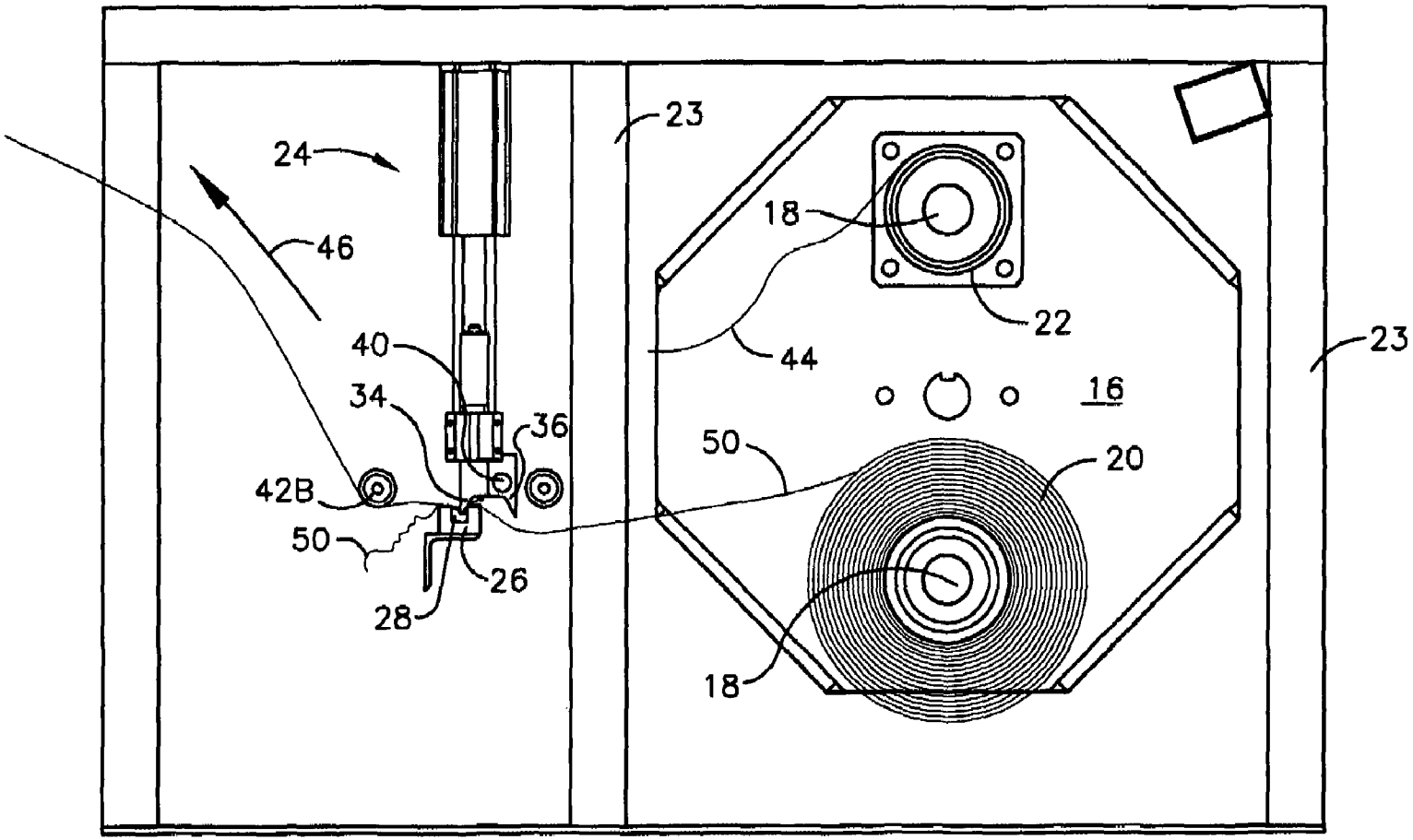
FIG. 5 is a partially cut-away view of the splicing device of the present invention immediately following the completion of the splicing/cutting operation in accordance with the present invention as shown in the larger view of FIG. 5.
Figure 6:
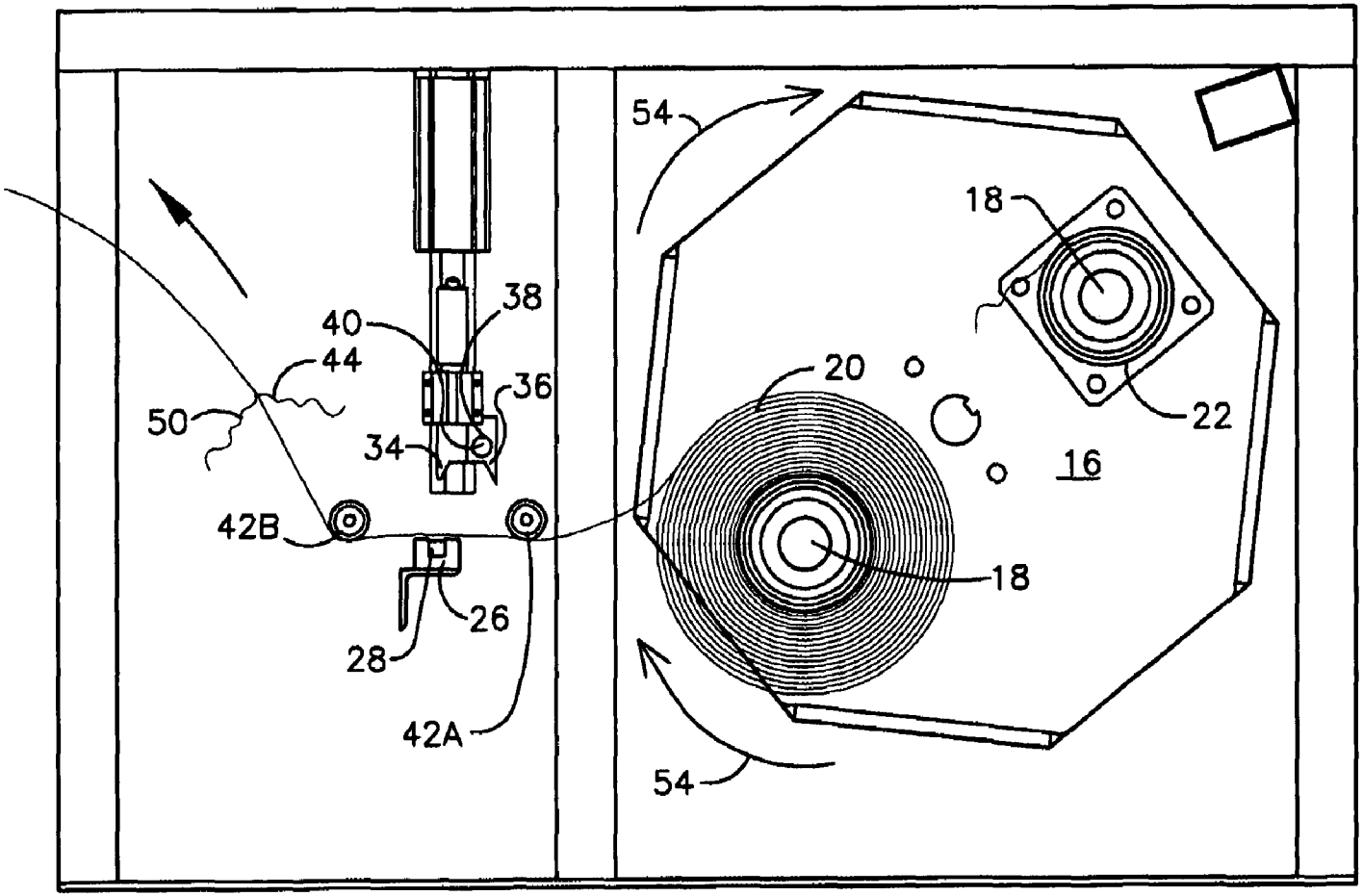
FIG. 6 is a partially cut-away view of the splicing device of the present invention showing rotation of the turret portion in accordance with a preferred embodiment of the present invention.
Figure 7:
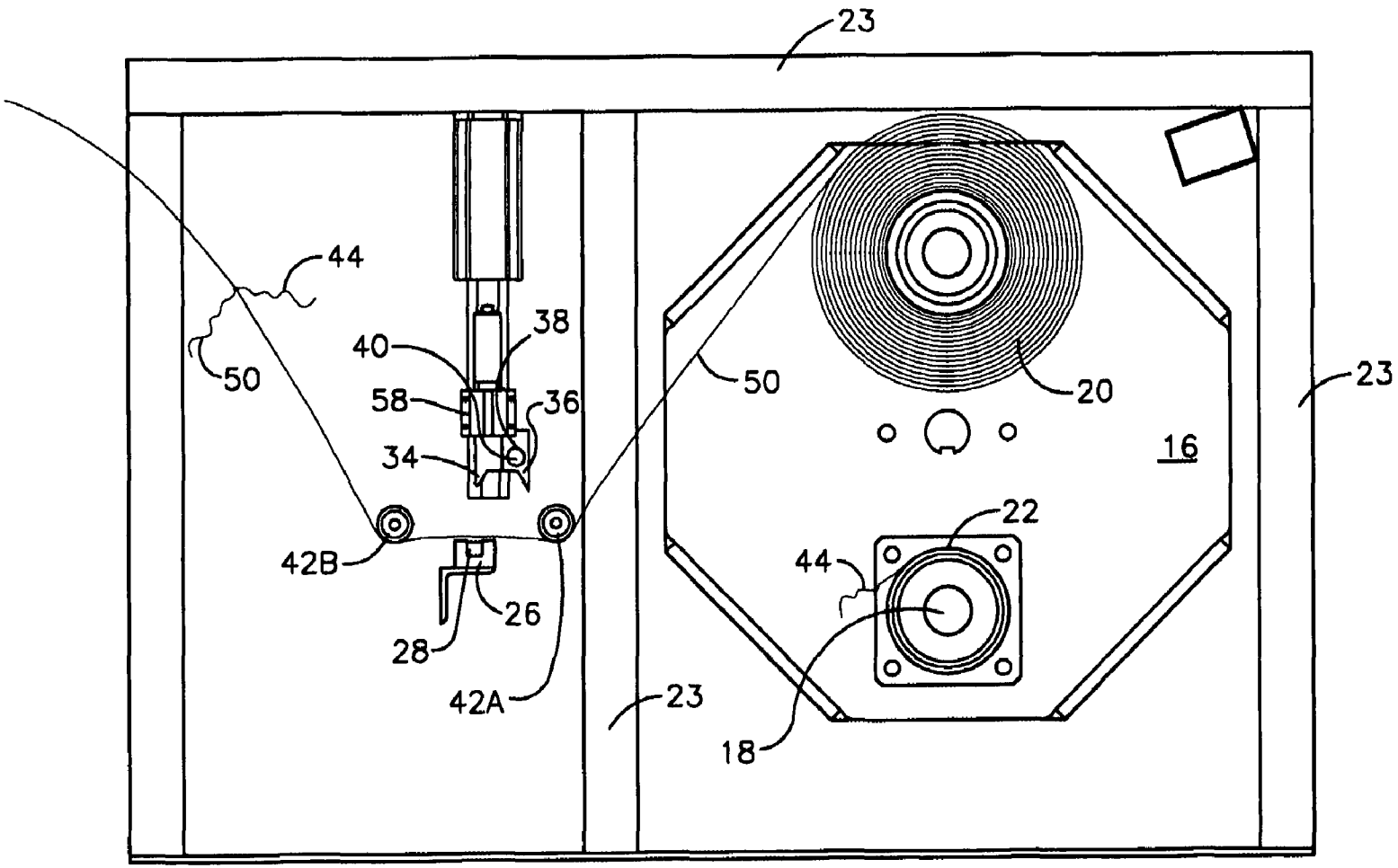
FIG. 7 is a partially cut-away view of the splicing device of the present invention showing the turret portion after completion of rotation in accordance with a preferred embodiment of the present invention.

Referring now to FIGS. 5–7 that depict the post welding and cutting sequence, as shown in FIG. 5, polymer film 44 is now disconnected from polymer film feed in the direction indicated by arrow 46 and film 50 is being drawn from spool 20 to provide for continuous and uninterrupted feeding downstream operations. In FIG. 6, turret section 12 including plate 16 and shafts 18 has begun rotation in the direction shown by arrows 54 and in FIG. 7 rotation is complete with roll 20 now located in the feed position while roll 22 is located in a position to be removed and a new supply roll placed on shaft 18.

As will be apparent to the skilled artisan, actuator 24 may comprise any of a well known number of actuating mechanisms such as pneumatic, hydraulic and servo based actuators. Spicing head support 56, although not essential to the operation of the device of the present invention is provided as additional attachments between actuator 24 and splicing head 30. Additionally, splicing head support 56, at its opposing extremities provides mounting points for brackets 58 that contact guide rails 60 as described below. As also shown in the accompanying Figures are auxiliary elements of splicing device 10 that significantly enhance its functioning in the particular application shown. These include brackets 58 that include recesses 62 that ride on guide rails 60 mounted to upright portions of frame 23A to provide stability and positional accuracy as polymer films 44 and 50 are being cut or welded to each other in the one stroke operation just described.

While tips 34 and 36 and anvil 28 can be fabricated from a wide variety of materials, the use of a high heat conductivity material such as aluminum or copper and alloys thereof has been found most desirable for fabrication of tips 34 and 36, while the use of a heat resistant foam such as one fabricated from a silicone polymer has been found most effective for anvil 26. Operating temperatures for tips 34 and 36 will, of course, vary with the material being welded/cut as well as the speed of operation, but are readily determinable by those skilled the polymer fusing/cutting arts.

There has thus been described a very simple yet highly effective high speed cutting and welding device for cutting and splicing a pair of overlying polymer sheets.

As the invention has been described, it will be apparent to those skilled in the art that the same may be varied in many ways without departing from the spirit and scope of the invention. Any and all such modifications are intended to be included within the scope of the appended claims.

What is claimed is:

1. A splicing device for simultaneously splicing a pair of overlying polymer films to form a spliced film and separating one of said films from said splice comprising:

A) an elongated anvil having an elongated slot therein;

B) an elongated splicing head having first and second spaced apart tips extending therefrom at least one of said spaced apart tips having a longitudinal aperture therein;

C) a heating element in said longitudinal aperture; and

D) an actuator mechanism connected to said elongated splicing head for driving one of said tips toward and into said elongated slot to weld said pair overlying polymer films together to form a welded pair of polymer films and the other of said tips into cutting contact with only one of said pair of polymer films, the first of said spaced apart tips positioned to weld said overlying polymer films while the second of said spaced apart tips is positioned to cut only one of said overlying polymer films to separate it from the welded pair of polymer films.

2. The splicing device of claim 1 wherein said anvil has a top surface and opposing lateral sides and further including a pair of opposed rollers located outward of said opposing lateral sides so as to guide and to maintain said pair of polymer films taut over said elongated slot.

3. The splicing device of claim 1 further including a longitudinal splicing head support connected to said blade and said actuator and a frame supporting the various elements of said device.

4. The splicing device of claim 3 wherein said longitudinal splicing head support has opposing extremities and further including;

A) as part of said frame, a pair of opposing upright supporting members at said opposing extremities;

B) guide rails located on each of opposing upright supporting members; and

C) brackets mounted on each of the opposed extremities of the longitudinal splicing head support and including recesses that engage said guide rails so as to guide reciprocal movement of said splicing head.

5. The splicing device of claim 1 further including a rotating turret mechanism comprising;

A) a rotating plate; and

B) at least two parallel polymer roll shafts protruding orthogonally from said plate and supporting rolls of polymer film;

such that polymer film is fed from one of said polymer rolls to and over said elongated slot until said one polymer roll is near exhaustion and splicing occurs whereupon said plate and said orthogonally protruding polymer roll shafts rotate to alter the relative positions of said orthogonally protruding polymer roll shafts.

6. The splicing device of claim 1 wherein said elongated splicing head is fabricated from a material selected from the group consisting of copper and aluminum and alloys thereof.

7. The splicing device of claim 1 wherein said anvil comprises a heat resistant polymeric foam.

8. The splicing device of claim 1 wherein said anvil comprises a material selected from the group consisting of copper and aluminum and alloys thereof.

9. The splicing device of claim 1 wherein the one of said tips that is driven and into said elongated slot has a greater radius of curvature that the other of said tips that serves to cut the polymer film.

* * * * *